US010827888B2

(12) United States Patent
Morrow et al.

(10) Patent No.: US 10,827,888 B2
(45) Date of Patent: Nov. 10, 2020

(54) VACUUM CLEANER

(71) Applicant: BISSELL Homecare, Inc., Grand Rapids, MI (US)

(72) Inventors: Nickolas James Morrow, Grand Rapids, MI (US); Christopher Derek Stirling, Holland, MI (US); Kenneth M. Lenkiewicz, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 391 days.

(21) Appl. No.: 15/883,871

(22) Filed: Jan. 30, 2018

(65) Prior Publication Data

US 2018/0153365 A1 Jun. 7, 2018

Related U.S. Application Data

(63) Continuation of application No. 14/822,270, filed on Aug. 10, 2015, now Pat. No. 9,901,230.

(60) Provisional application No. 62/035,743, filed on Aug. 11, 2014.

(51) Int. Cl.
*A47L 9/04* (2006.01)

(52) U.S. Cl.
CPC ..... *A47L 9/04* (2013.01)

(58) Field of Classification Search
CPC . A47L 9/04; A47L 5/28; A47L 9/1427; A47L 5/30; A47L 9/242; A47L 5/34; A47L 9/00; A47L 9/2821; A47L 9/0072; A47L 9/0081; F16K 11/00; F16K 11/06; F16K 11/07

See application file for complete search history.

(56) References Cited

U.S. PATENT DOCUMENTS

| | | | | |
|---|---|---|---|---|
| 4,490,882 | A | 1/1985 | Wells | |
| 5,050,266 | A * | 9/1991 | Schneider | A47L 9/0072 15/330 |
| 5,293,665 | A | 3/1994 | Woerwag | |
| 5,537,710 | A | 7/1996 | Alberts, III | |
| 5,704,090 | A * | 1/1998 | Berfield | A47L 9/0072 15/339 |
| 7,293,326 | B2 | 11/2007 | Luebbering | |
| 7,779,860 | B2 * | 8/2010 | Pears | A47L 9/0072 137/556 |
| 8,966,709 | B2 | 3/2015 | Coleman | |
| 2006/0162119 | A1 | 7/2006 | Smith | |
| 2011/0214250 | A1 * | 9/2011 | McLeod | A47L 9/0072 15/383 |
| 2011/0265283 | A1 * | 11/2011 | Duncan | A47L 9/14 15/347 |
| 2014/0101889 | A1 | 4/2014 | Davidshofer | |
| 2014/0283332 | A1 * | 9/2014 | Conrad | A47L 5/30 15/389 |

(Continued)

FOREIGN PATENT DOCUMENTS

| | | | |
|---|---|---|---|
| EP | 2941994 | A1 | 11/2015 |
| GB | 2504940 | A | 2/2014 |

*Primary Examiner* — Robert J Scruggs
(74) *Attorney, Agent, or Firm* — McGarry Bair PC

(57) ABSTRACT

A vacuum cleaner is provided with an improved air bleed valve for adjusting the level of suction and air flow through a working air path fluidly connecting a working air inlet with a separating and collection assembly. The air bleed valve can be provided on upright handle assembly of the vacuum cleaner, and can form a portion of the working air path.

20 Claims, 13 Drawing Sheets

(56) References Cited

U.S. PATENT DOCUMENTS

| | | | |
|---|---|---|---|
| 2015/0059123 | A1 | 3/2015 | Kasper |
| 2015/0074939 | A1 | 3/2015 | Cipolla |

* cited by examiner

178

VACUUM CLEANER

CROSS-REFERENCE TO RELATED APPLICATION

This application is a continuation of U.S. patent application Ser. No. 14/822,270, filed Aug. 10, 2015, now U.S. Pat. No. 9,901,230, issued Feb. 27, 2018, which claims the benefit of U.S. Provisional Patent Application No. 62/035,743, filed Aug. 11, 2014, both of which are incorporated herein by reference in their entirety.

BACKGROUND

Upright vacuum cleaners can include a handle assembly pivotally mounted to a foot assembly for maneuvering the vacuum cleaner across a surface to be cleaned. The foot assembly can include a sole plate that defines a suction nozzle inlet that is fluidly connected to a downstream portion of a working air path. A vacuum hose can be fluidly coupled to the working air path and can include an auxiliary suction inlet, such as a wand inlet defined by a suction wand, for above-the-floor cleaning. An air bleed valve in communication with the suction wand can be opened to selectively leak ambient air into the working air stream to decrease the level suction at the suction wand inlet and the airflow through the suction wand. Reducing suction at the wand inlet can enable a user to clean relatively delicate items, such as curtains or other fabrics, without the fabric becoming sucked into the suction opening or to dislodge any debris clogging the suction wand. Typically, the air bleed valve is provided on the wand, and thus has no effect on the level of suction or air flow through the suction nozzle inlet in the foot assembly.

Vacuum cleaners can also employ separation and collections systems, which can include one or more filters upstream and/or downstream from the suction source for filtering the working airflow before it enters the suction source and/or before the working airflow is exhausted out of the vacuum cleaner, into the atmosphere. The filter can include multiple filter layers with different filtration properties, such as progressively smaller pore sizes to filter dust and debris of different sizes out of the working air stream. Correct orientation of the filter assembly with respect to the filter housing is vital to prevent premature filter clogging and to ensure optimal cleaning performance of the vacuum cleaner.

BRIEF SUMMARY

Embodiments of the invention relate to a vacuum cleaner having a housing adapted for movement over a surface to be cleaned, an upright handle assembly pivotally mounted to the housing, a separating and collection assembly, a working air path having a working air inlet fluidly connected with the separating and collection assembly, a suction source in fluid communication with the separating and collection assembly and configured to generate a working air stream through the working air path, and an air bleed valve configured to adjust a level of suction and air flow through the working air path.

In one aspect, the invention relates to the air bleed valve including a valve conduit forming a portion of the working air path and comprising a conduit air vent therein and a vent collar rotatably mounted on the valve conduit and comprising a collar air vent therein. The vent collar is configured to selectively rotate the collar air vent into register with the conduit air vent to reduce the level of suction and air flow through the working air path and to selectively rotate the collar air vent out of register with the conduit air vent to increase the level of suction and air flow through the working air path.

In another aspect, the invention relates to the air bleed valve being provided on the upright handle assembly and forming a portion of the working air path downstream from a vacuum hose and upstream of the air inlet to the separating and collection assembly, wherein the air bleed valve is configured to adjust the level of suction and air flow through the vacuum hose.

DETAILED DESCRIPTION

The invention relates to vacuum cleaners. In one of its aspects, the invention relates to an improved pre-motor filter mounting configuration that prevents misassembly and incorrect orientation of a multi-layer pre-motor filter assembly. In another aspect, the invention relates to an improved air bleed valve, which may be used for reducing suction at one or multiple suction inlets for the vacuum cleaner. In yet another aspect, the invention relates to an improved working air channel defined in part by a removable sole plate/cover provided on a foot assembly of the vacuum cleaner. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
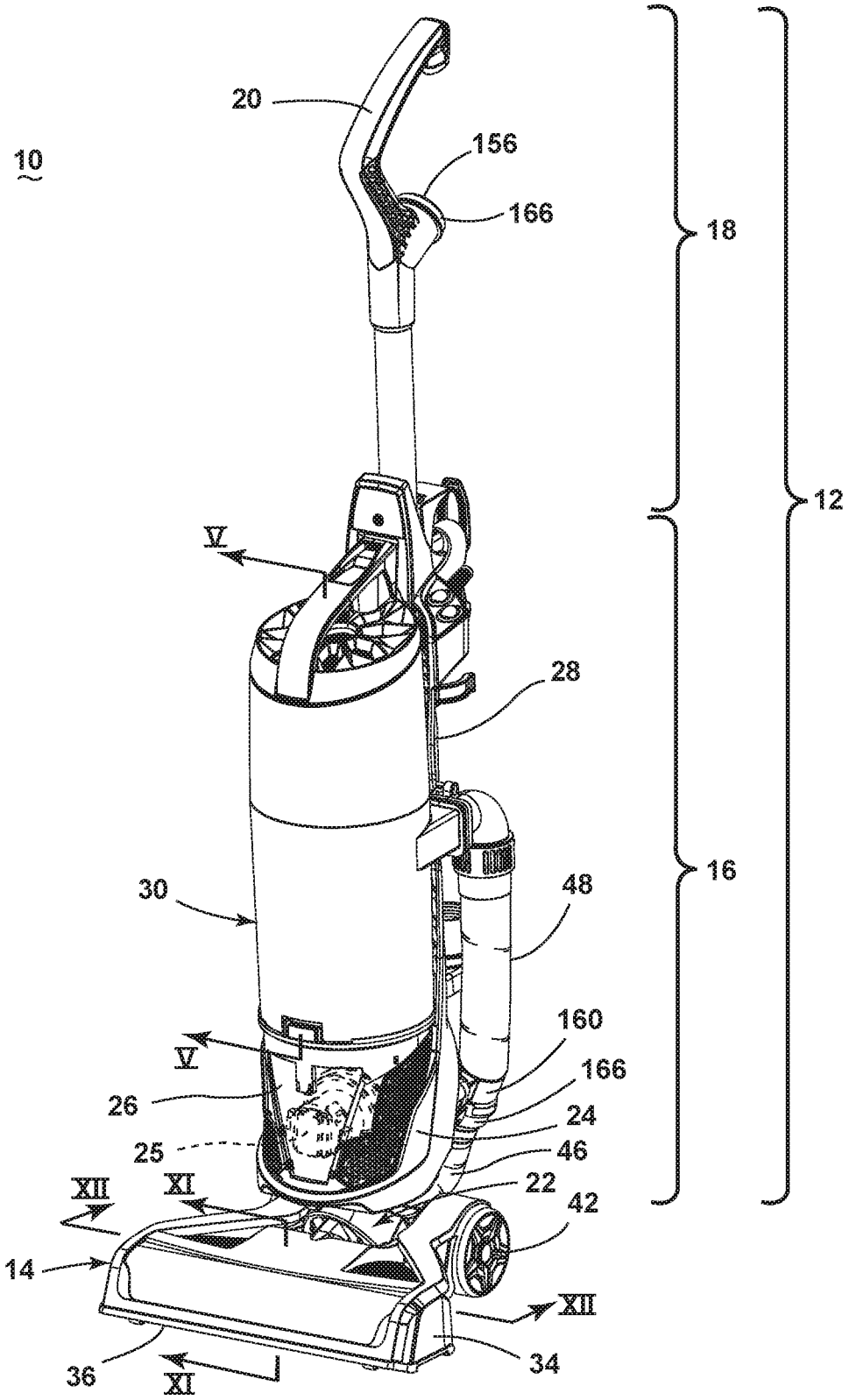
FIG. 1 is a front perspective view of a vacuum cleaner with a removable suction wand according to a first embodiment of the invention.

FIG. 1 shows a front perspective view of an upright vacuum cleaner 10 according to an embodiment of the invention comprising an upright handle assembly 12 pivotally mounted to a foot assembly 14. The handle assembly 12 comprises a primary support section 16 and an upper section 18 terminating in a grip 20 to facilitate movement by a user. In one configuration illustrated herein, the handle assembly 12 pivots relative to the foot assembly 14 through a first and second pivot axis defined by a multi-axis swivel joint 22. Alternatively, a single axis joint may also be used.

A motor cavity 24 is formed at an opposite end of the handle assembly 12 to contain a conventional suction source such as a vacuum fan/motor assembly 25, which can be oriented transversely therein. A post-motor filter housing 26 is formed adjacent and forward of the motor cavity 24 and is in fluid communication with the vacuum fan/motor assembly 25, and receives a filter media (not shown) for filtering air exhausted from the vacuum fan/motor assembly 25 before the air exits the vacuum cleaner 10. A mounting section 28 on the primary support section 16 of the handle assembly 12 receives a separation/collection module 30 for separating debris (which may include dirt, dust, soil, hair, and other debris) and other contaminants from a debris-containing working airstream. The foot assembly 14 comprises a housing 34 with a suction nozzle 36 formed at a lower surface thereof that is in fluid communication with the suction source. When the separation/collection module 30 is received in the mounting section 28, as shown in FIG. 1, the separation/collection module 30 is in fluid communication with, and fluidly positioned between, the suction nozzle 36 and the vacuum fan/motor assembly 25 within the motor cavity 24. At least a portion of the working air pathway between the suction nozzle 36 and the separation/collection module 30 can be formed by a flexible foot conduit 46 that is fluidly connected between the suction nozzle 36 and a vacuum hose 48. To transition from floor cleaning mode, shown in FIGS. 1-2 to above-the-floor cleaning mode, shown in FIG. 3, the vacuum hose 48 can be selectively disconnected from fluid communication with the foot conduit 46. A separate extension vacuum hose 50, shown in FIG. 2, can be selectively fluidly connected to the vacuum hose 48 to extend the reach of the hose during above-the-floor cleaning mode.

Figure 4:
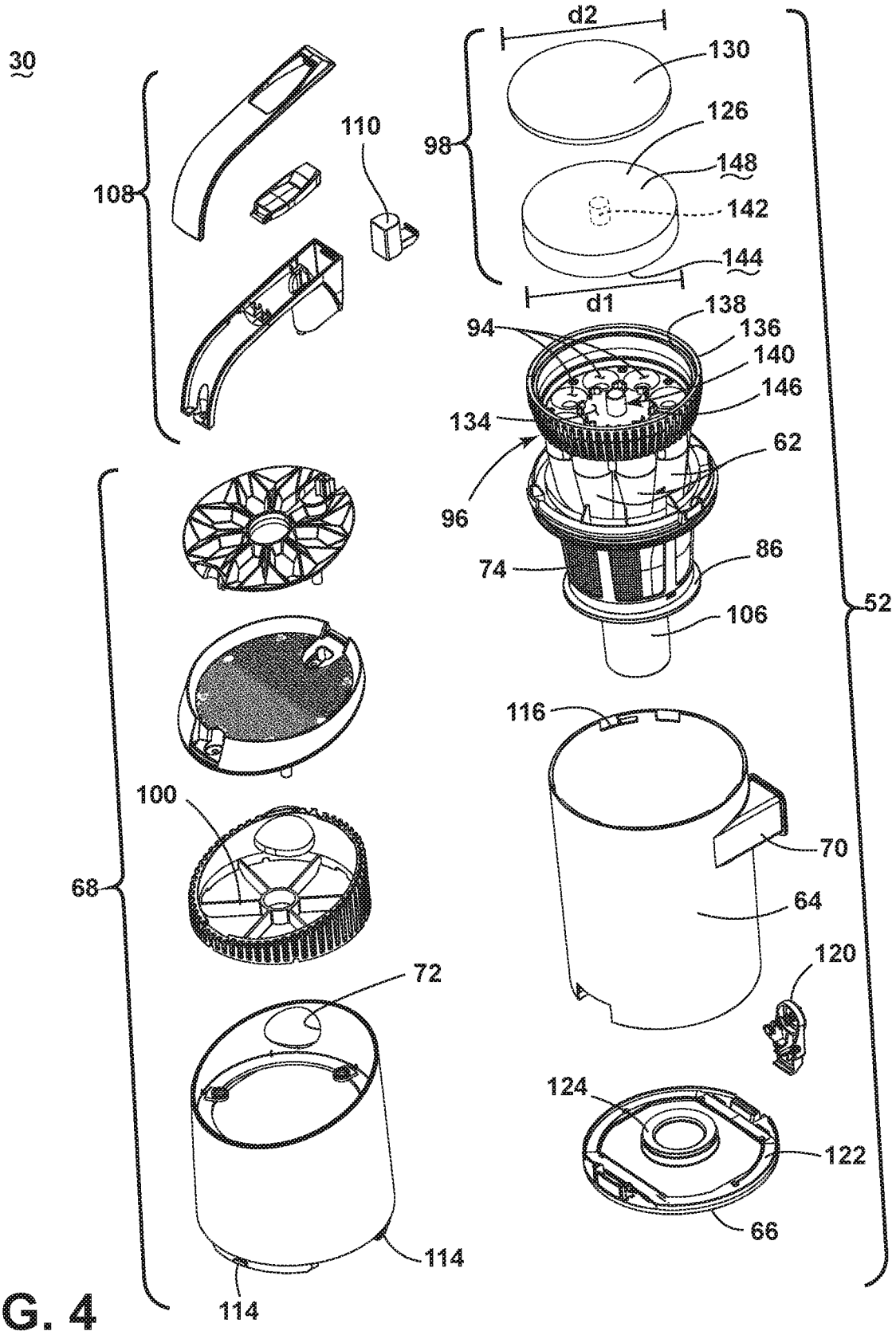
FIG. 4 is a partial exploded perspective view of a separation/collection module for the vacuum cleaner of FIG. 1.
Figure 5:
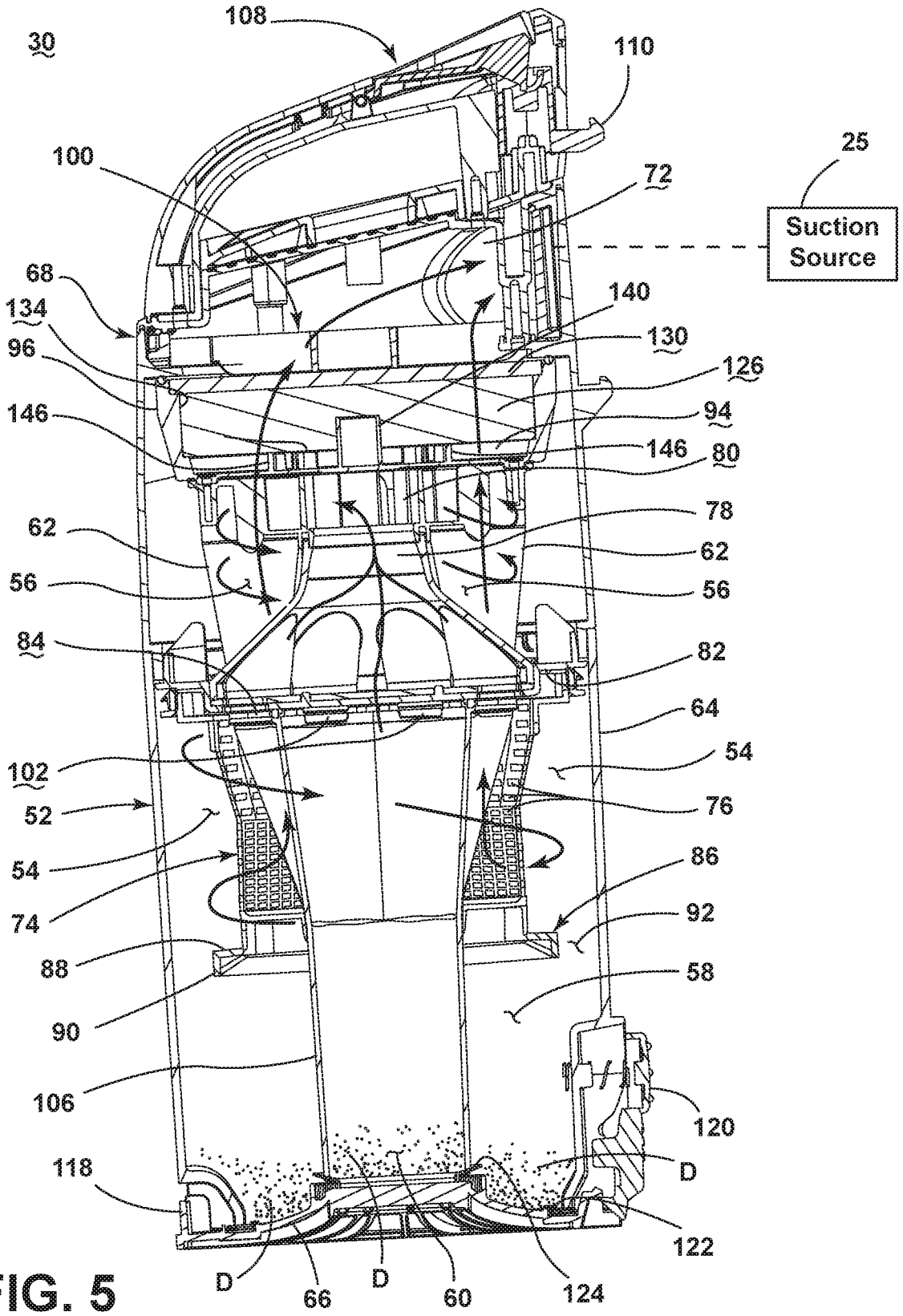
FIG. 5 is a partial cross-sectional view of the separation/collection module, taken along line V-V of FIG. 1.

Referring to FIGS. 4 and 5, the separation/collection module 30 comprises a module housing 52 at least partially defining a first stage cyclone chamber 54 and second stage cyclone chamber 56 for separating contaminants from a debris-containing working airstream and an integrally-formed first stage debris collection chamber 58 and second stage debris collection chamber 60, which receive contaminants separated by the first and second stage cyclone chambers 54, 56 respectively. In one configuration illustrated herein, the second stage cyclone chamber 56 can comprise multiple downstream secondary cyclones 62 arranged in parallel.

The module housing 52 is common to the first stage cyclone chamber 54 and the first stage collection chamber 58, and includes a side wall 64, a bottom wall 66, and a cover 68. The side wall 64 is illustrated herein as being generally cylindrical in shape. The bottom wall 66 comprises a debris door that can be selectively opened, such as to empty the contents of the first and second stage collection chambers 58, 60.

An inlet to the separation/collection module 30 can be at least partially defined by an inlet conduit 70. An outlet from the separation/collection module 30 can be at least partially defined by an outlet conduit 72 provided on the cover 68. The inlet conduit 70 is in fluid communication with the suction nozzle 36 and the outlet conduit 72 is in fluid communication with a suction source, such as the vacuum fan/motor assembly 25, within the motor cavity 24 (see FIG. 1).

The separation/collection module 30 further includes an exhaust grill 74 having openings 76 for guiding working air from the first stage cyclone chamber 54, through a passageway 78 to at least one secondary inlet 80 of the second stage cyclone chamber 56. The exhaust grill 74 is positioned in the center of the first stage cyclone chamber 54 and can depend from a top wall 82 of the chamber 54. The exhaust grill 74 can separate the first stage cyclone chamber 54 from the upstream, second stage cyclone chamber 56. The top wall 82 includes openings 84 allowing working air to pass through the exhaust grill 74 and passageway 78, into the secondary inlets 80.

A separator plate 86 can be provided below the exhaust grill 74 to separate the first stage cyclone chamber 54 from the first stage collection chamber 58, and can include a disk-like surface 88 extending radially outwardly from the grill 74 and a downwardly depending peripheral lip 90. A debris outlet 92 from the first stage cyclone chamber 54 can be defined between the separator plate 86 and the side wall 64.

The second stage cyclone chamber 56 is defined by a plurality of frusto-conical secondary cyclones 62 arranged in parallel. Each of the secondary cyclones 62 comprises a secondary inlet 80 in fluid communication with the passageway 78 that is configured to receive working air through the openings 76 in the exhaust grill 74. A secondary exhaust outlet 94 is formed at the top of each secondary cyclone 62. A pre-motor filter housing 96 extends upwardly from the top of the second stage cyclone chamber 56 and is fluidly connected to the secondary exhaust outlets 94. A pre-motor filter assembly 98 is mounted within the pre-motor filter housing 96 upstream of the outlet conduit 72, such that air exiting the second stage cyclone chamber 56 must pass through the filter assembly 98 prior to passing out of the module 30. The cover 68 comprises a filter support rib lattice 100 that abuts the top of the filter assembly 98 to hold it in place during operation. The support rib lattice 100 comprises holes that allow working air to pass out of the filter assembly 98 and through the outlet conduit 72.

A secondary debris outlet 102 is defined by an opening at the bottom of each secondary cyclone 62. The second stage debris collection chamber 60 is defined by a fines collector tube 106 depending downwardly from the secondary debris outlets 102, through the center of the separation/collection module 30 and abutting the bottom wall 66.

A handle grip 108 attached to the cover 68 can be gripped by a user to facilitate lifting and carrying the entire vacuum cleaner 10 or just the separation/collection module 30 when removed from the vacuum cleaner 10. The handle grip 108 can be provided with a latch 110 for selectively detaching the separator/collection module 30 from the upright assembly 12.

The cover 68 can be removably mounted to the housing 52 via fasteners to access the filter assembly 98 for cleaning or replacement. In one configuration, the fasteners can comprise bayonet hooks 114 formed on a lower outer portion of the cover 68 that are configured to be mounted in corresponding bayonet slots 116 formed in an upper portion of the side wall 64.

While the first stage and second stage cyclone chambers 54, 56 and first stage and second stage collection chambers 58, 60 are shown herein as being integrally formed, it is also contemplated that the separation/collection module 30 can be provided with a separate debris cup having a closed or fixed bottom wall and that is removable from the first stage and second stage cyclone chambers 54, 56 to empty debris collected therein. Furthermore, while a multi-stage cyclone is illustrated herein, it is also contemplated that the separation/collection module 30 can be configured with single or dual separation stages. As illustrated herein, the separation and collection module is shown as a cyclone module. However, it is understood that other types of separation modules can be used, such as a bulk separator or filter bag, for example.

The bottom wall 66 comprises a debris door that is pivotally mounted to the side wall 64 by a hinge 118. A door latch 120 is provided on the side wall 64, opposite the hinge 118, and can be actuated by a user to selectively release the debris door from engagement with the bottom edge of the side wall 64 and the bottom edge of the fines collector tube 106. The door latch 120 comprises a latch that is pivotally mounted to the side wall 64 and spring-biased toward the closed position shown in FIG. 5. By pressing the upper end of the door latch 120 toward the side wall 64, the lower end of the door latch 120 pivots away from the side wall 64 and releases the debris door, under the force of gravity, allowing accumulated debris to be emptied from the primary and secondary collection chambers 58, 60 through the open bottom of the module housing 52 and fines collector tube 106. A first gasket 122 can be provided between the bottom wall 66/debris door and the bottom edge of the side wall 64 and a second gasket 124 can be provided between the bottom wall 66/debris door and the bottom of the fines collector tube 106 to seal the interfaces therebetween when the bottom wall 66/debris door is closed.

Figure 5A:
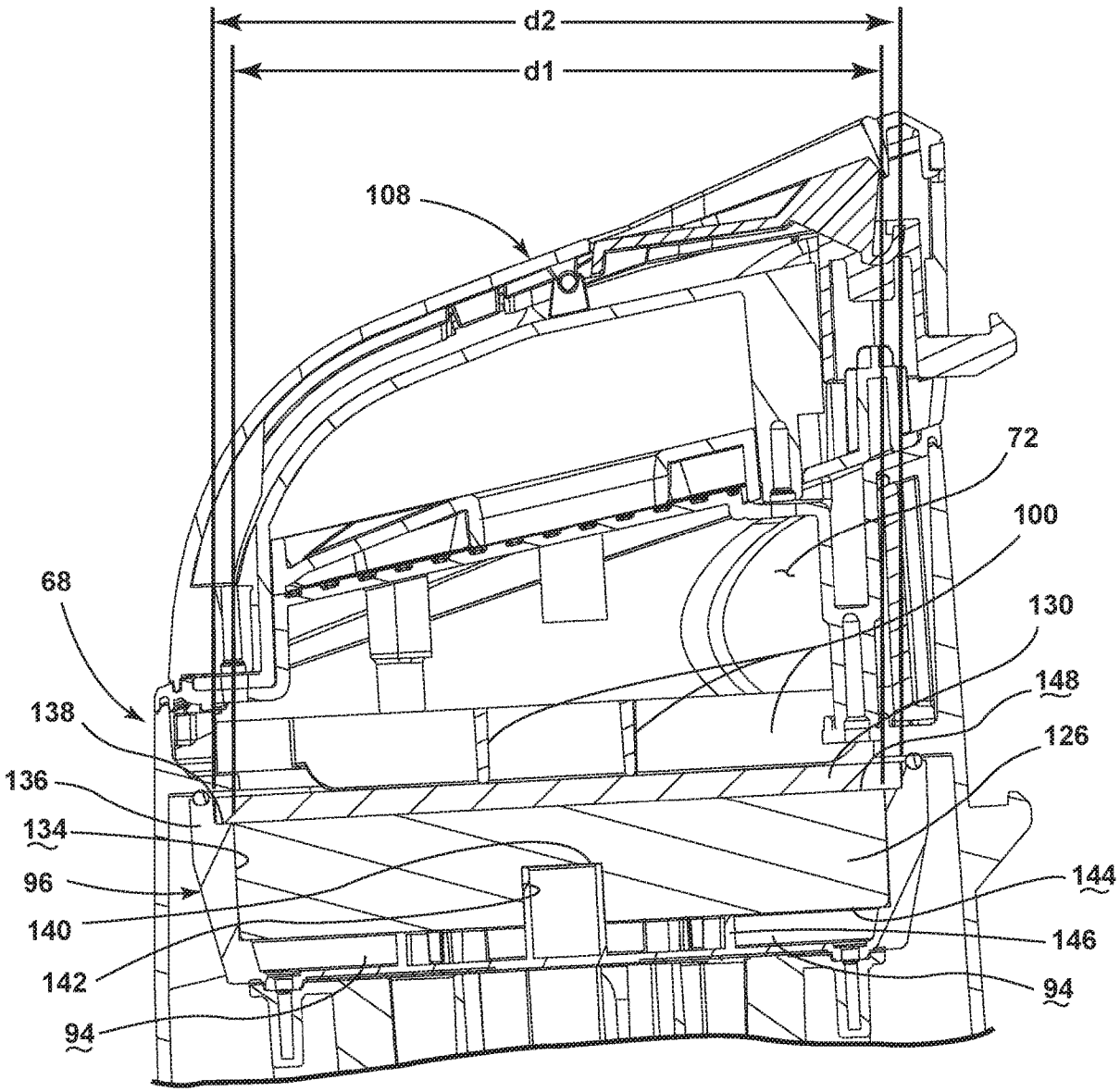
FIG. 5A is a close-up, cross-sectional view of a portion of the separation/collection module shown in FIG. 5.

With additional reference to FIG. 5A, the filter assembly 98 comprises a bottom filter layer 126 of filter media having an outer diameter, d1, and a top filter layer 130 of filter media having an outer diameter, d2, the diameter, d2, being larger than diameter, d1. The filter media can comprise one or a combination of suitable filter media types such as porous foam, paper, melt-blown nonwoven polymer, or pleated filter media, including high efficiency particulate air (HEPA), or combinations thereof, for example. In one configuration, d1 is about 122 mm and d2 is about 128.5 mm. However, alternative diameters are contemplated wherein d2 is preferably between 2 mm and 30 mm larger than d1.

The filter media can be selected so that the bottom filter layer 126 is configured to remove course particles from the working air stream, upstream from the top filter layer 130, which can be configured to capture fine particles out of the working air stream after it passes through the bottom filter layer 126. The bottom and top filter layers 126, 130 can be inserted into a cavity 134 defined by the filter housing 96. The cavity 134 can comprise a cylindrical peripheral wall 136 having an inward step 138. The lower portion of the wall 136 is configured to seat the bottom filter layer 126 and has a smaller diameter than the upper portion, which is configured to seat the top filter layer 130, which has a larger diameter than the bottom filter layer 126. The bottom filter layer 126 can be received within the cavity 134 below the inward step, and the top filter layer 130 can be received within the cavity 134 on the inward step 138.

A boss 140 extends upwardly from the center of the cavity 134 and prevents incorrect assembly of the bottom filter layer 126 and top filter layer 130. A centrally located recess 142 in an upstream filter side 144 of the bottom filter layer 126 is configured to slide over the boss 140. As best shown in FIG. 5A, when the bottom filter layer 126 is properly seated within the cavity 134, the upstream filter side 144 abuts a plurality of stand-off ribs 146 in the bottom of the filter housing 96 and a downstream filter side 148 of the filter layer 126 is flush with the top of the inward step 138. The stand-off ribs 146 maintain a predetermined gap between the bottom of the filter housing 96 and the upstream filter side 144 so that the working air stream can be dispersed over the entire surface area of the upstream filter side 144 of the bottom filter layer 126. The recess 142 does not extend through the entire thickness of the bottom filter layer 126.

The bottom filter layer 126 can only be inserted into the cavity 134 in one orientation. Specifically, if the recess 142 is not inserted over the boss 140, the bottom filter layer 126 will not nest properly and will protrude above the cavity 134, thus preventing the cover 68 from being properly mounted to the housing 52. Similarly, the top filter layer 130 does not have a recess, so the top filter layer 130 cannot be inserted beneath the bottom filter layer 126 because that arrangement would cause the boss 140 to interfere with the solid central portion of the top filter layer 130, which would prevent the entire filter assembly 98 from nesting properly within the cavity 134 and would thus prevent the cover 68 from being properly mounted to the housing 52.

The inward step 138 also ensures proper orientation of the bottom and top filter layers 126, 130 with respect to each other because it prevents the top filter layer 130 having diameter, d2, from being inserted first, beneath the bottom filter layer 126 since the outer edge of the top filter layer 130 would interfere with the inward step 138.

Referring to FIG. 5, in which the flow path of working air is indicated by arrows, the operation of the separation/collection module 30 will be described. The suction source, when energized, draws debris and debris-containing air from the suction nozzle 36, through the vacuum hose 48 to the inlet conduit 70 and into the separation/collection module 30 where the dirty air swirls around the first stage cyclone chamber 54. Debris D falls into the first stage debris collection chamber 58. The working air, which may still contain some smaller or finer debris, then passes through the exhaust grill 74 and proceeds upwardly within passageway 78 and is distributed through the secondary inlets 80 of the secondary cyclones 62. The dirty air swirls around the second stage cyclone chamber 56. Debris D falls through the secondary debris outlets 102 into the second stage debris collection chamber 60. The working air then passes through the secondary exhaust outlet 94 and through the pre-motor filter assembly 98, where additional debris may be captured, with larger debris being captured in the bottom filter layer 126 and finer debris being captured in the top filter layer 130. The working air then exits the separation/collection module 30 via the outlet conduit 72, and passes through the suction source 25 before being exhausted from the vacuum cleaner 10. One or more additional filter assemblies may be positioned upstream or downstream of the suction source 25. For example, a post-motor filter media can be provided in the post-motor filter housing 26 (FIG. 1), and filters working air that has been exhausted from the suction source 25. To dispose of collected debris, the separation/collection module 30 is detached from the vacuum cleaner 10 to provide a clear, unobstructed path for the debris captured in the first stage debris collection chamber 58 and second stage debris collection chamber 60 to be emptied when the bottom wall 66 defining a debris door is opened.

Figure 2:
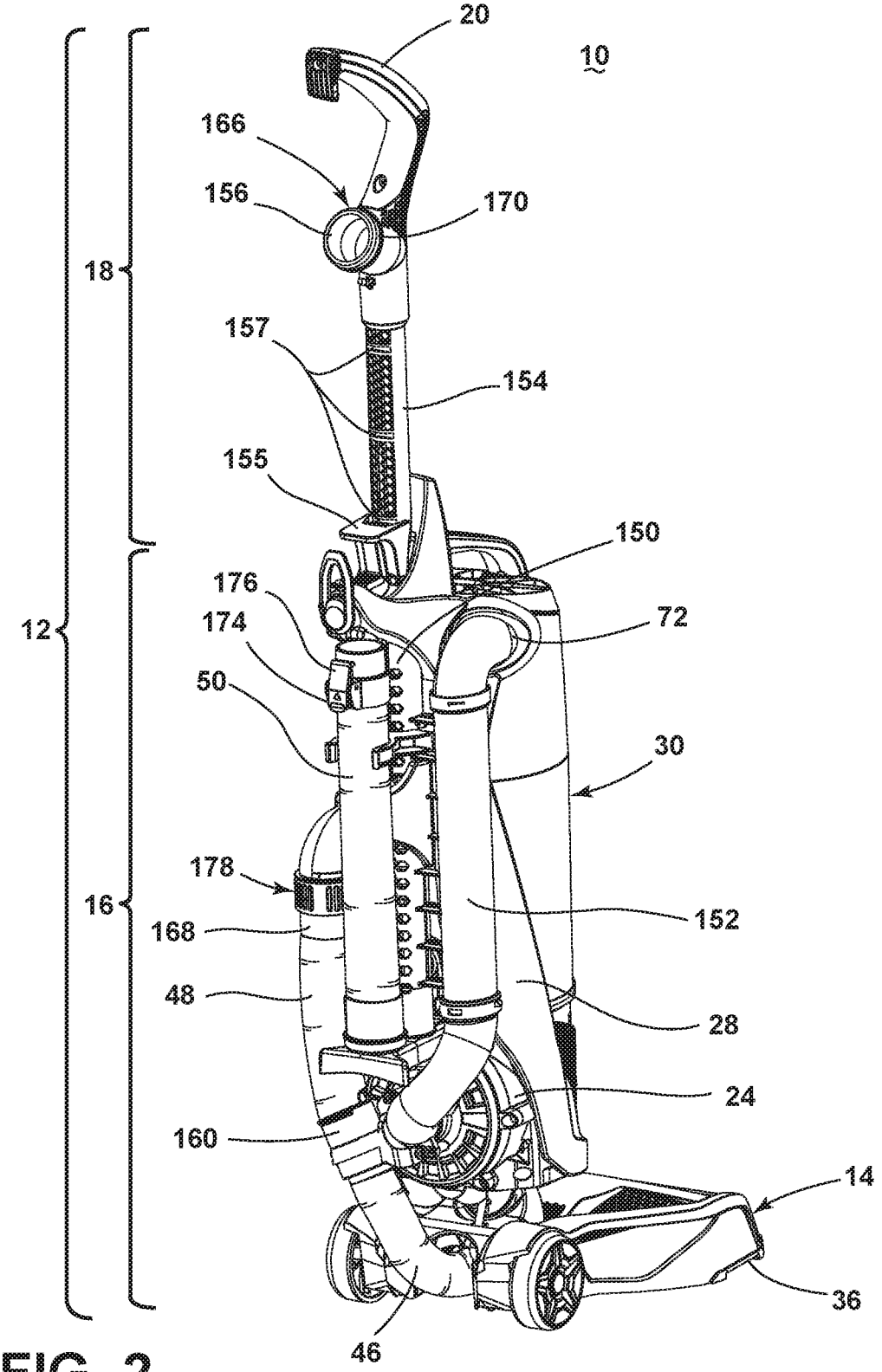
FIG. 2 is a rear perspective view of the vacuum cleaner of FIG. 1.

Referring to FIG. 2 which shows a rear perspective view of the vacuum cleaner 10 in floor cleaning mode, the primary support section 16 is defined in part by an elongate tubular spine 150 adjacent to a conduit pipe 152. The spine 150 slidably receives the upper section 18 of the handle assembly 12, which comprises a suction wand 154 that is configured for telescopic movement within the spine 150. The conduit pipe 152 is fluidly connected between the outlet conduit 72 and the motor cavity 24. A handle locking mechanism 155 selectively engages detents 157 on the outer surface of the suction wand 154 for adjusting the handle height position to the desired setting. The grip 20 on one end of the suction wand 154 comprises a wand outlet 156 which defines a portion of the air path through the hollow suction wand 154.

Figure 3:
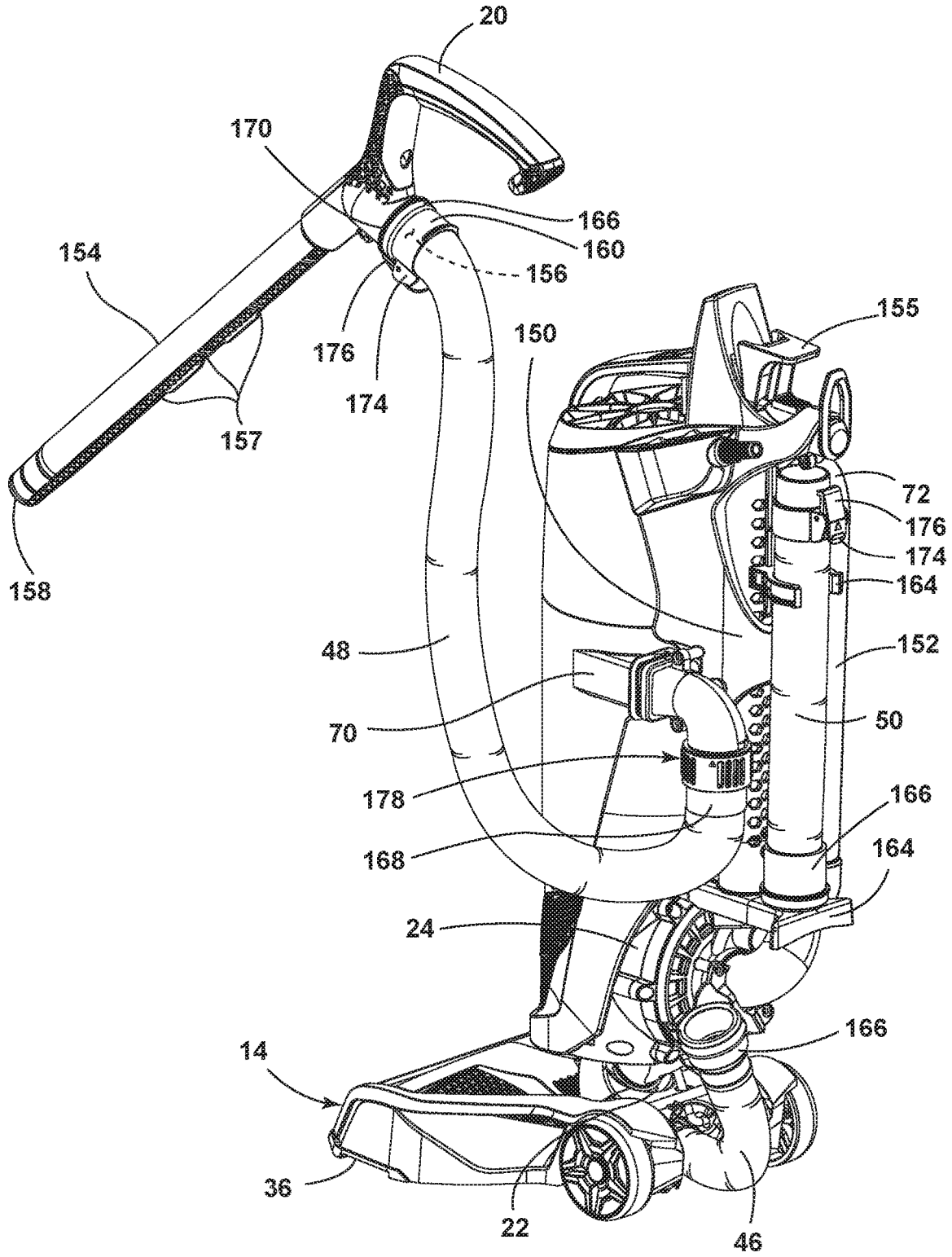
FIG. 3 is a rear perspective view of the vacuum cleaner of FIG. 1 with the suction wand deployed for above-the-floor cleaning through the vacuum hose.

FIG. 3 shows a rear perspective view of the vacuum cleaner 10 with the suction wand 154 removed from the spine 150 and a free hose end 160 of the vacuum hose 48 fluidly connected to the wand outlet 156 for above-the-floor cleaning mode. The wand outlet 156 is adapted to be selectively fluidly connected to a free hose end 160 of the vacuum hose 48 for drawing a working air stream therethrough. Thus, the suction wand 154 forms a portion of the working air path when the wand 154 is removed from the spine 150 and the vacuum cleaner 10 is used in above-the-floor cleaning mode. The opposite end of the wand defines a wand inlet 158 that is configured to mount various vacuum accessory tools (not shown) for different cleaning needs, such as a crevice tool, upholstery brush, or dusting tool for example.

Optionally, the free hose end 160 can be selectively fluidly connected to an extension hose 50, which can be fluidly connected between the free hose end 160 and the wand outlet 156 to increase the reach of the suction wand 154 during above-the-floor cleaning mode. The extension hose 50 can be stored on a hose mount 164, which is located on the rear of the primary support section 16. When the vacuum cleaner 10 is used in floor cleaning mode, the free hose end 160 can be fluidly connected to an outlet of the flexible foot conduit 46, which is fluidly connected to a hose coupling 166 mounted on a rear portion of the motor cavity 24, downstream from and in fluid communication with the suction nozzle 36.

A hose coupling 166 can also be provided on the wand outlet 156 and extension hose 50 in addition to the foot conduit 46 for engaging the free hose end 160. In one configuration, the hose coupling 166 can comprise a collar with a retainer flange 170 and a seal (not shown). The free hose end 160 comprises at least one retention latch 174 for securing the hose end 160 to the hose coupling 166. In one configuration illustrated herein, the retention latch 174 can further comprise a hook 176 at the distal end and can be pivotally mounted to the hose end 160 such that the hook 176 can be pivoted inwardly and outwardly between a locked and unlocked position. The retention latch 174 can be spring biased such that the hook 176 is normally biased inwardly into the locked position for engaging the retainer flange 170. To release the hose end 160 from a hose coupling 166, a user can depress one end of the retention latch 174 to pivot the retention latch 174 and disengage the hook 176 from the retainer flange 170 and then pull the hose end 160 away from the hose coupling 166. The hose end 160 can optionally comprise a seal (not shown) to minimize air leaks at the junctions between the hose end 160 and the hose coupling 166. A similar retention latch 174 and hook 176 can be provided on the extension vacuum hose 50.

The opposite end 168 of the vacuum hose 48 is fixedly mounted to an air bleed valve 178 mounted on the primary support section 16 in fluid communication with the inlet conduit 70. The air bleed valve 178 is configured to be selectively opened or closed, either completely or partially, to adjust the level of suction and air flow through the working suction inlet. For purposes of discussion herein, the working suction inlet may be defined by the suction nozzle 36 when the vacuum cleaner is in the floor cleaning mode shown in FIGS. 1-2, or the wand inlet 158 when the vacuum cleaner is in the above-the-floor cleaning mode shown in FIG. 3. For above-the-floor cleaning, the suction inlet may also be defined by a suction inlet on an accessory tool provided on the suction wand 154 or any other inlet of the vacuum hose 48.

In floor cleaning mode, the suction and air flow through the suction nozzle 36 can be reduced by opening the air bleed valve 178 completely or partially. Conversely, the suction and air flow through the suction nozzle 36 can be increased by closing the air bleed valve 178 completely or partially. Whereas in above-the-floor cleaning mode, suction and air flow through the suction wand 154 can be reduced by opening the air bleed valve 178 completely or partially, or increased by closing the air bleed valve 178 completely or partially. Selectively reducing the suction and air flow enables a user to dislodge any debris clogging a suction opening and also enables the vacuum cleaner 10 to clean relatively delicate items, such as curtains or other fabrics in above-the-floor cleaning mode, or rugs in floor cleaning mode, without the fabric or rug becoming sucked into the suction opening. The air bleed valve 178 can be adjusted incrementally between a minimum suction setting, MIN, in which the valve is entirely open and suction and air flow through the suction inlet is minimized, and a maximum suction setting, MAX, in which the valve is entirely closed and suction and air flow through the suction inlet is maximized. The air bleed valve 178 is configured so it can be incrementally adjusted to gradually reduce or increase the suction and airflow through the suction inlet to a desired level.

Figure 6:
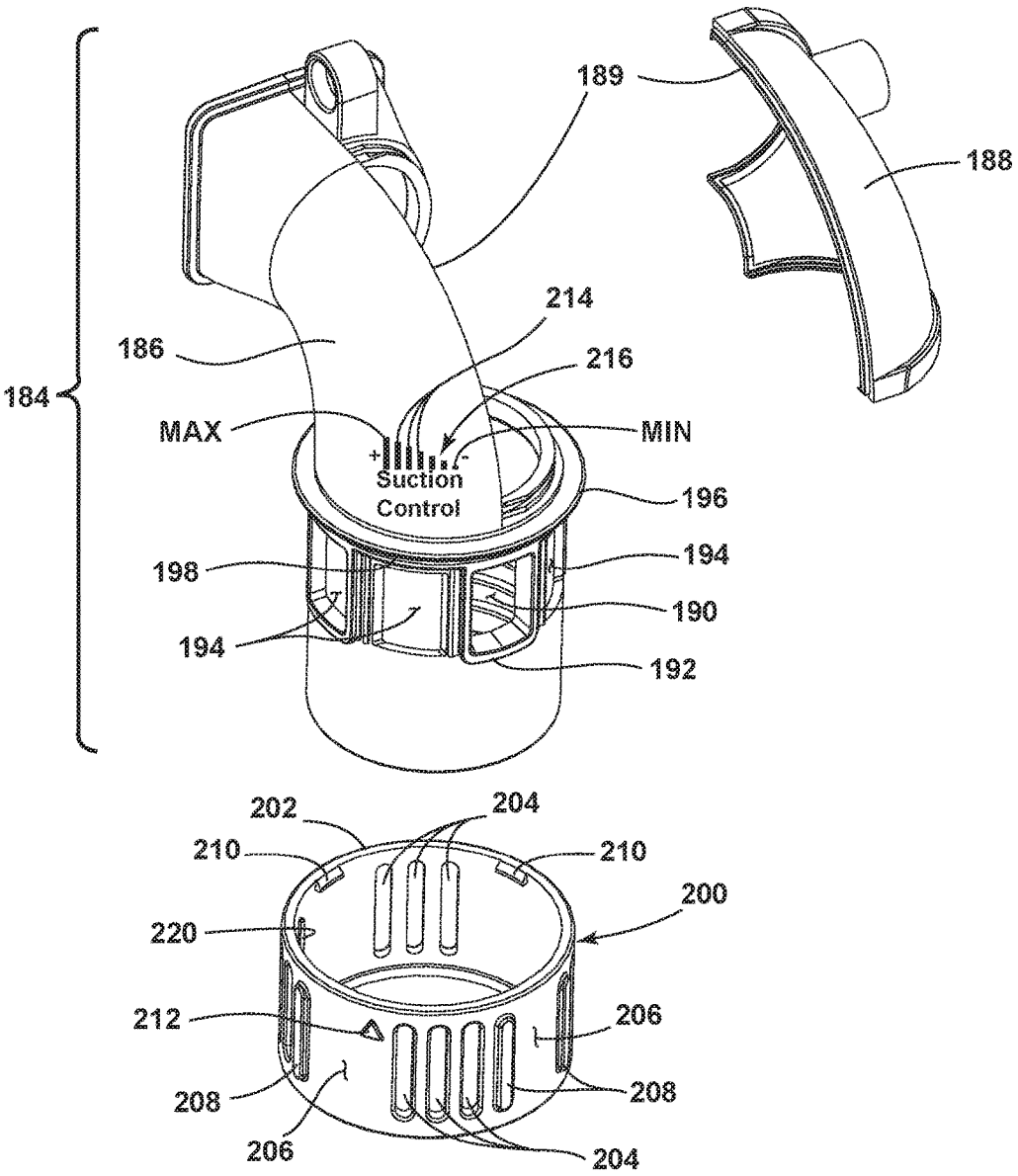
FIG. 6 is a partial exploded perspective view of a bleed valve assembly of FIG. 1.

FIG. 6 is an exploded perspective view of the air bleed valve 178 comprising a valve conduit 184 defined by an elbow-shaped conduit housing 186 and a mating conduit cover 188 that can be fastened by a suitable manufacturing process such as plastic welding, adhesive, or mechanical fasteners for example. The mating edges of the conduit housing 186 and conduit cover 188 can further comprise a tongue and groove joint 189 to prevent air leaks. An air vent aperture 190 is formed around a lower cylindrical portion of the conduit housing 186. The aperture 190 illustrated herein is defined by a rectangular wall 192 that protrudes outwardly from and is concentric to the surface of the conduit housing 186. Other shapes for the wall 192 defining the aperture 190 are also possible. A solid wall portion 194 of the conduit housing 186 is provided adjacent to the air vent aperture 190. In one configuration, two apertures 190 are formed on the lower portion of the conduit housing 186 and are oriented 180 degrees from each other on opposed portions of the perimeter of the conduit housing 186 and separated by a plurality of solid wall portions 194. Only one of the two apertures 190 is visible in FIG. 6. An annular flange 196 protrudes outwardly from the conduit housing 186, above the air vent apertures 190, and forms a portion of an upper portion of an annular mounting groove 198 for rotatably mounting a vent collar 200 thereon.

The vent collar 200 is configured to be rotatably mounted to the lower portion of the conduit housing 186 and can be rotated into different positions for selectively opening and closing the air bleed valve 178. The vent collar 200 comprises a cylindrical wall 202 with a plurality of vent slots 204 that form elongate apertures therethrough. The inner surface of the vent collar 200 abuts a sealing surface formed on the outermost edge of the rectangular walls 192 that define the air vent apertures 190. The vent collar 200 is configured to selectively and incrementally block and unblock the air vent apertures 190 completely or partially to increase or decrease suction and airflow through the upstream suction inlet between the minimum, suction setting MIN, and maximum suction setting, MAX. In one configuration illustrated herein, the vent slots 204 are arranged in two separate groups comprising three vent slots 204 each. The groups of vent slots 204 are spaced 180 degrees around the vent collar 200 and a solid collar wall portion 206 without any apertures is provided between each group of vent slots 204. Grip ribs 208 can protrude from the outer surface of the collar 200 for enhancing a user's grip to facilitate rotation of the vent collar 200 relative to the conduit housing 186. The vent collar 200 can comprise a hook 210 that protrudes inwardly from the top of the solid wall portion 206. In one configuration, the vent collar 200 comprises two hooks 210. The ends of the hooks 210 nest in the annular mounting groove 198 and slidably retain the vent collar 200 to the conduit housing 186.

The vent collar 200 further comprises an indicator arrow 212 that can be aligned with a desired suction setting 214 on a suction control gage 216 provided on the conduit housing 186. The suction control gage 216 comprises vertical bars that gradually increase in height to indicate multiple increasing suction settings 214 from a minimum suction setting, MIN, which is denoted as the shortest bar, to a maximum suction setting, MAX, which is denoted as the tallest bar.

Figure 7:
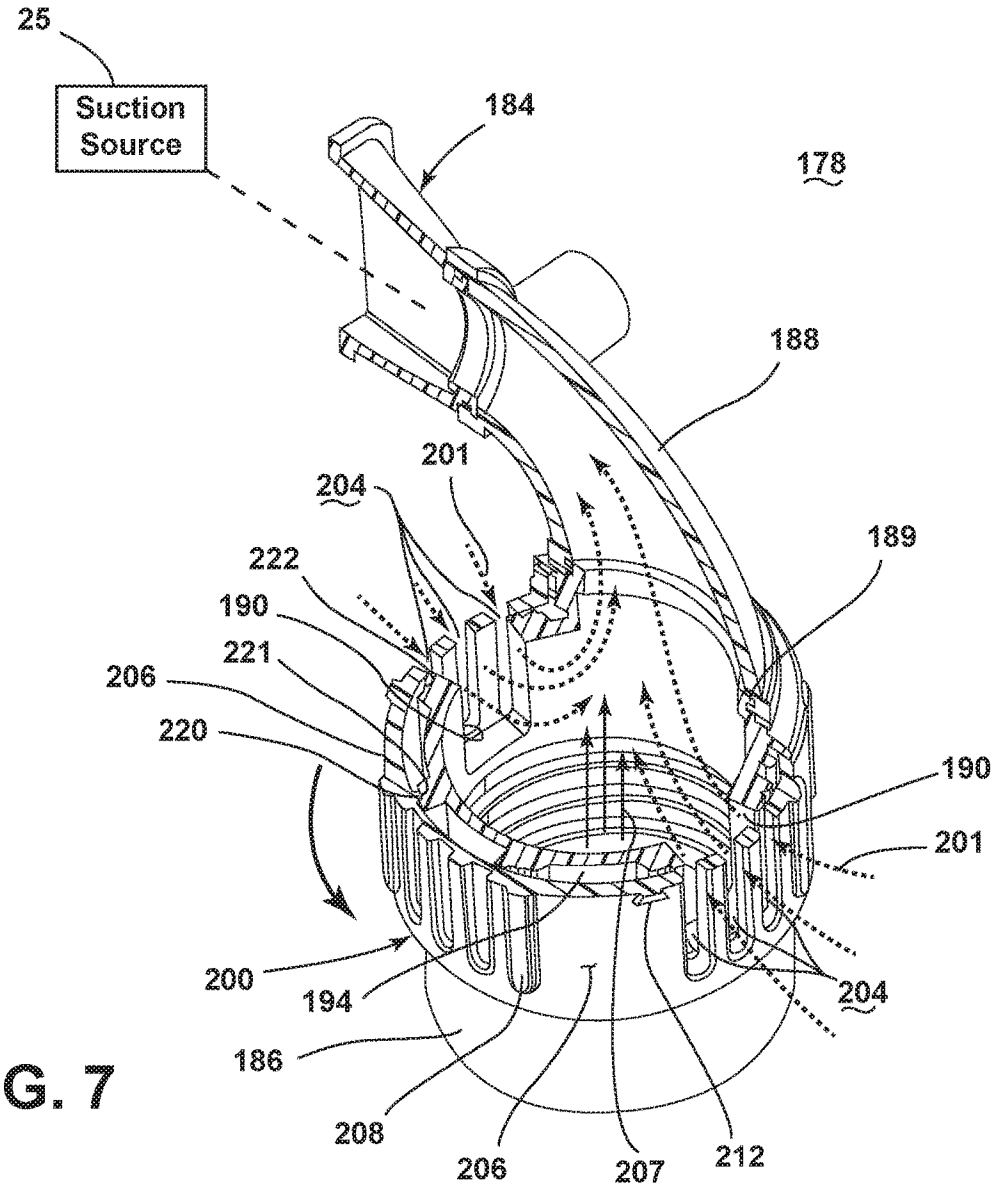
FIG. 7 is a partial cut-away perspective view of a bleed valve assembly in an open, minimum suction position.

FIG. 7 is a partial cut-away view showing the air bleed valve 178 in the minimum suction setting, MIN, with the vent collar 200 rotated to its counter-clockwise limit so the vent slots 204 are aligned with the air vent apertures 190. In the MIN suction setting, ambient air, which is schematically indicated by arrows 201, is drawn through the openings defined by the aligned vent slots 204 and air vent apertures 190 by the suction source 25, which reduces the level of suction and volume of working air, schematically indicated by arrows 207, drawn through the suction inlet and passing through the valve conduit 184.

Figure 8:
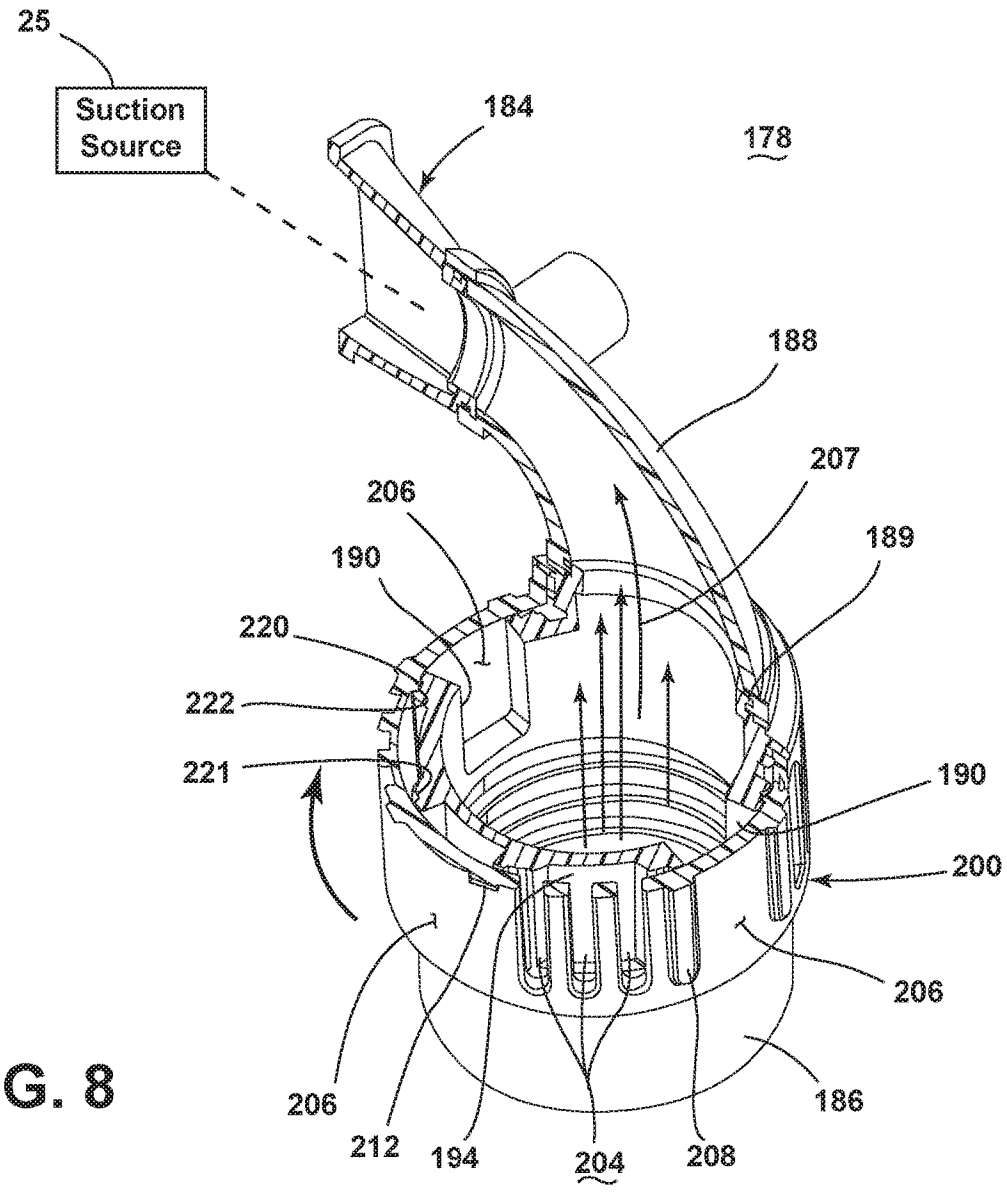
FIG. 8 is a partial cut-away perspective view of a bleed valve assembly in a closed, maximum suction position.

FIG. 8 is a partial cut-away view showing the air bleed valve 178 in the maximum suction setting, MAX, with the vent collar 200 rotated to its clock-wise limit so the vent slots 204 are not aligned with the air vent apertures 190 and with the solid collar wall portion 206 overlying and blocking the air vent apertures 190 and the vent slots 204 overlying the solid wall portions 194 so that no ambient air can be drawn in through the vent collar 200. In the MAX suction setting all working air flow, which is schematically indicated by arrows 207, is drawn through the suction inlet by the suction source 25 and passes through the valve conduit 184 and no ambient air is drawn in through the vent slots 204 or air vent apertures 190, which maximizes the level of suction and volume of working air drawn through the suction inlet.

The air bleed valve 178 can also be adjusted to multiple intermediate suction settings with the vent collar 200 rotated so that the vent slots 204 are only partially aligned with the air vent apertures 190 so that some of the vent slots 204 partially overlie the air vent apertures 190 whereas other vent slots 204 overlie the solid wall portion 194. In an intermediate suction setting, a limited amount of ambient air is drawn through the openings defined by the partially aligned vent slots 204 and air vent apertures 190, which partially reduces the level of suction and volume of working air flow drawn through the suction inlet as compared to the MAX suction setting.

A detent can be provided between the vent collar 200 and the conduit housing 186 so the vent collar 200 can be easily and accurately indexed to the desired suction setting 214. In one configuration illustrated herein, a detent protrusion 220 is provided on the inner solid collar wall portion 206 and is configured to snap into a first or second detent recess 221, 222, which are formed on the outer surface of the conduit housing 186. When the detent protrusion 220 is snapped into the first detent recess 221 the vent collar 200 is in the minimum suction position, MIN, as shown in FIG. 7. When the detent protrusion is snapped into the second detent recess 222, the vent collar is in the maximum suction position, MAX, as shown in FIG. 8. The detent protrusion 220 and detent recesses 221, 222 retain the vent collar 200 in the desired suction setting position while also providing tactile feedback to the user as the vent collar 200 is rotated relative to the conduit housing 186.

To reduce suction and air flow through the suction inlet, a user can open the air bleed valve 178 by rotating the vent collar 200 counter-clockwise and aligning the indicator arrow 212 with the minimum suction setting, MIN, so the air vent slots 204 completely overlie the air vent apertures 190 and the air bleed valve 178 is fully open (FIG. 7). To increase suction and air flow through the suction inlet, a user can close the air bleed valve 178 by rotating the vent collar 200 clockwise and aligning the indicator arrow 212 with the maximum suction setting, MAX, so the air vent apertures 190 are blocked by the solid collar wall portion 206, the air vent slots 204 overlie the solid wall portion 194 and the air bleed valve 178 is fully closed (FIG. 8). Alternatively, the air bleed valve 178 can be partially opened by rotating the vent collar 200 and aligning the indicator arrow 212 with one of the intermediate suction settings 214, so the air vent slots 204 partially overlie the air vent apertures 190 and the air bleed valve 178 is partially open. The indicator arrow 212 and suction control gage 216 can be molded, printed or hot stamped onto the corresponding vent collar 200 and conduit housing 186 components. In one configuration illustrated herein, the indicator arrow 212 is molded onto the outer surface of the vent collar 200 and the suction control gage 216 is hot stamped onto the outer surface of the conduit housing 186.

While it is contemplated that the MIN/MAX will correspond to fully closed/open positions, respectively, of the air bleed valve 178, it need not be the case. The air bleed valve 178 may be fully or partially opened/closed for the corresponding MIN/MAX position. It is only necessary that the MAX position provide greater suction at the suction inlet than the MIN position.

Figure 9:
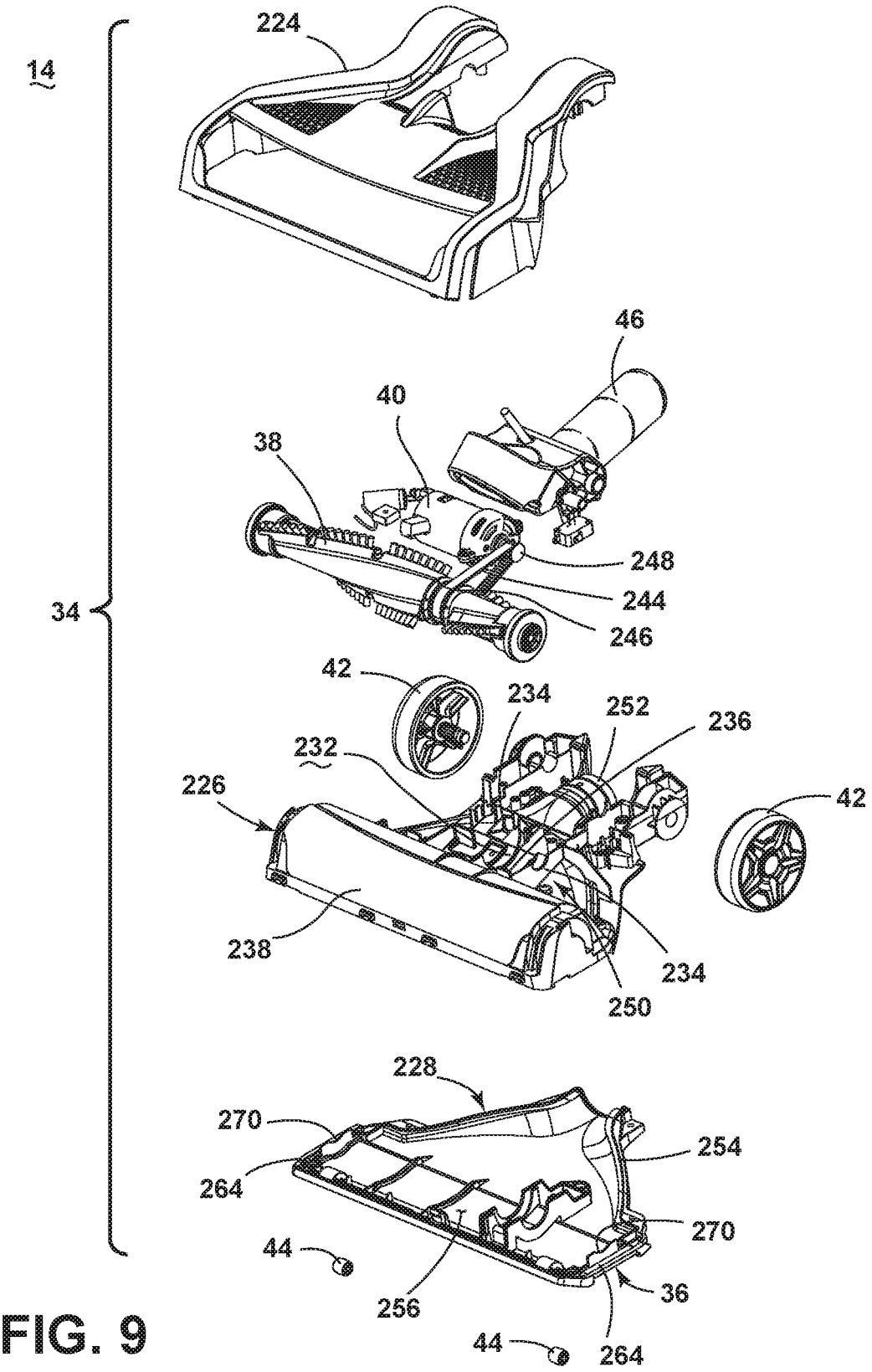
FIG. 9 is a partial exploded perspective view of a foot assembly of the vacuum cleaner of FIG. 1.
Figure 10:
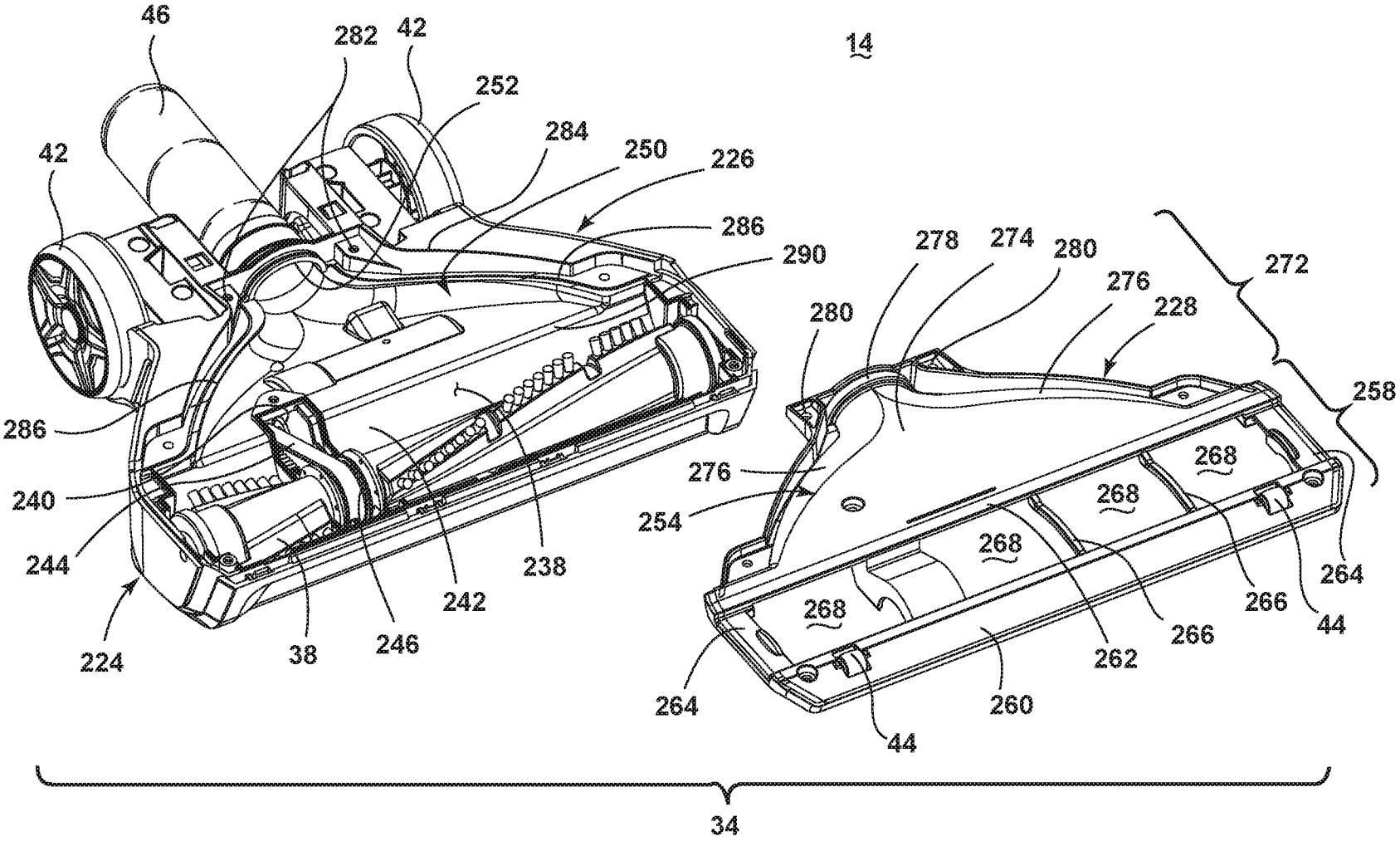
FIG. 10 is a partial exploded bottom perspective view of a foot assembly of the vacuum cleaner of FIG. 1.

FIG. 9 shows a partial exploded perspective view of the foot assembly 14 and FIG. 10 shows a partial exploded bottom perspective view of the foot assembly 14. The foot assembly 14 comprises a housing 34 that includes a cover housing 224, a base housing 226 and a sole plate/cover 228. The base housing 226 is fastened to the cover housing 224 via mechanical fasteners (not shown). The sole plate/cover 228 is fastened to the bottom of the base housing 226 by mechanical fasteners (not shown) and partially encloses a necked-down suction channel 230 (FIG. 11) formed therebetween. An agitator 38 can be positioned within the housing 34 adjacent the suction nozzle 36 and operably connected to a dedicated agitator motor 40. Alternatively, the agitator 38 can be operably connected to a drive shaft (not shown) of the vacuum fan/motor assembly 25 within the motor cavity 24 via a stretch belt. Rear wheels 42 are secured to a rearward portion of the foot assembly 14 and front wheels 44 are secured to a forward portion of the foot assembly 14 for moving the foot assembly 14 over a surface to be cleaned.

A cavity 232 for mounting the agitator motor 40 is formed between the cover housing 224 and base housing 226. Motor mounting features are provided on the base housing 226 for securing the agitator motor 40 thereto, such as cradle ribs 234 and mounting bosses 236. An agitator chamber 238 is formed on a forward portion of the base housing 226 and is configured to rotatably mount the agitator 38 therein. A slot 240 is provided in a rear wall 242 of the agitator chamber 238 for a drive belt 244 that extends from inside the agitator chamber 238 to the motor mounting cavity 232 to operably connect a belt engaging surface 246 of the agitator 38 with a drive shaft 248 on the agitator motor 40. The rear portion of the base housing 226 defines an upper channel 250 which defines an upper portion of the necked-down suction channel 230 that fluidly connects the agitator chamber 238 with a channel outlet 252 at the opposite end of the base housing 226. The channel outlet 252 comprises an elliptical-shaped sleeve with a downstream end that is fluidly connected to the flexible foot conduit 46, which is in fluid communication with the downstream working air path, including the vacuum hose 48, separation/collection module 30 and suction source 25.

The sole plate/cover 228 is fastened to the bottom of the base housing 226 and defines a lower channel 254 of the necked-down suction channel 230 and a suction nozzle inlet 256 of the suction nozzle 36. The forward portion of the sole plate/cover 228 comprises a rectangular frame portion 258 having a front wall 260, rear wall 262 joined by opposing side walls 264. Cross ribs 266 extend perpendicularly between the front wall 260 and rear wall 262. The space between the cross ribs 266, side walls 264, and front and rear walls 260, 262 define multiple suction nozzle openings 268, which collectively form the suction nozzle inlet 256. Agitator retention features 270 are provided on the opposing side walls 264, such as ribs that are configured to mount the agitator 38 adjacent to the suction nozzle inlet 256 so that the agitator 38 extends over the suction nozzle openings 268 and in register with the surface to be cleaned.

The rear portion of the sole plate/cover 228 comprises a cover 272 that defines the lower channel 254 of the necked-down suction channel 230. The cover 272 comprises a bottom wall 274 and opposed cover side walls 276 that extend rearwardly from the rear wall 262 of the sole plate/cover 228 and terminate at a semi-circular cuff 278 at the rear of the sole plate/cover 228. The cover side walls 276 gradually taper inwardly and the height of the cover side walls 276 gradually increases from the rear wall 262 towards the semi-circular cuff 278. The cuff 278 has mounting tabs 280 that can be fastened to bosses 282 adjacent to the channel outlet 252. The cover 272 mates to a recess 284 formed in the bottom of the base housing 226. The recess 284 is defined by stepped walls 286 that further define the open bottom of the upper channel 250. The cover side walls 276 nest within the stepped walls 286 such that the bottom wall 274 of the cover 272 is flush with the bottom of the base housing 226. The semi-circular cuff 278 can be sealingly fastened to the channel outlet 252. A seal (not shown) can be provided between the cuff 278 and channel outlet 252 to prevent air leaks through the joint. The cover 272 partially encloses the necked-down suction channel 230 to form a working air path from the suction nozzle inlet 256 to the channel outlet 252.

Figure 11:
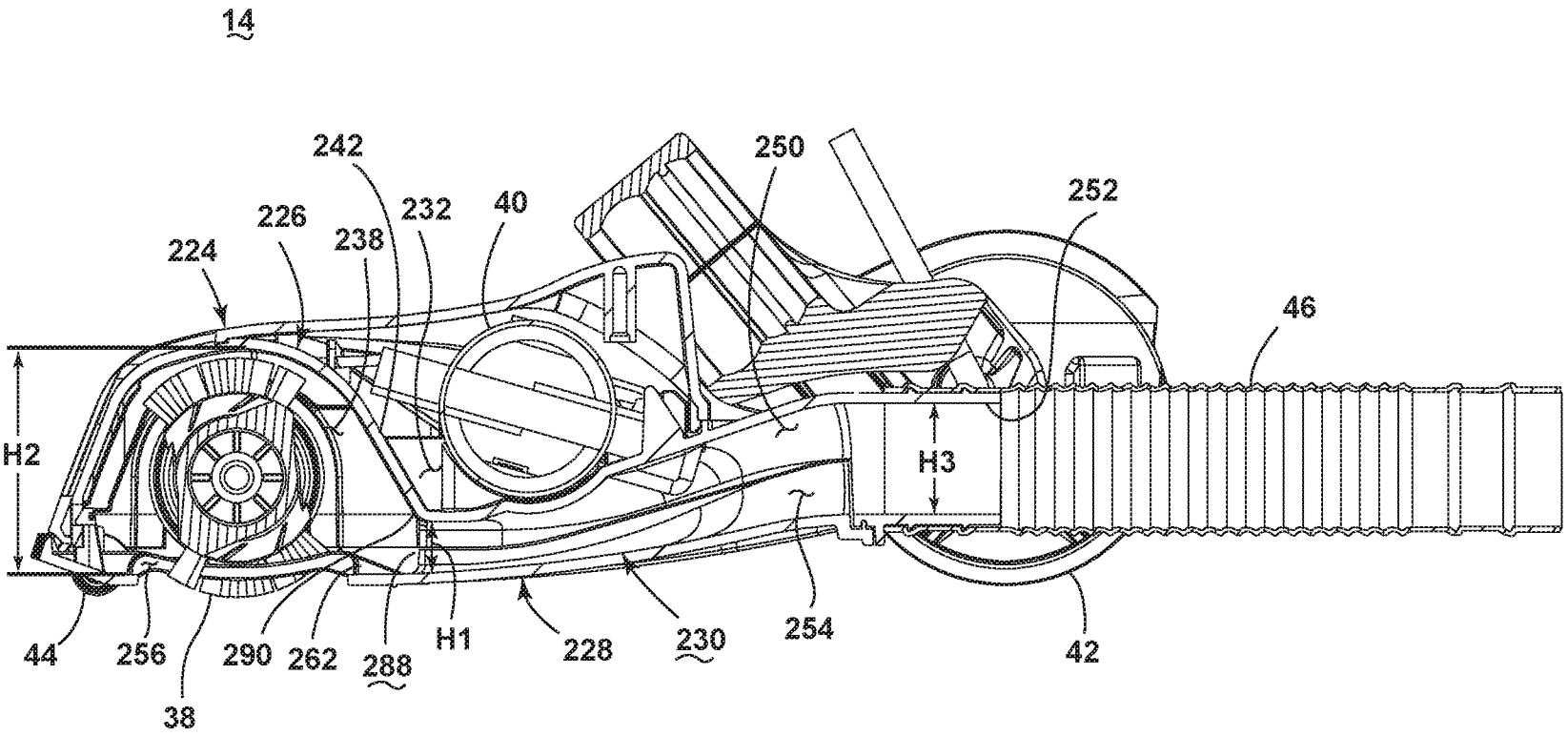
FIG. 11 is a partial cross-sectional view of the foot assembly of the vacuum cleaner taken along line XI-XI of FIG. 1.
Figure 12:
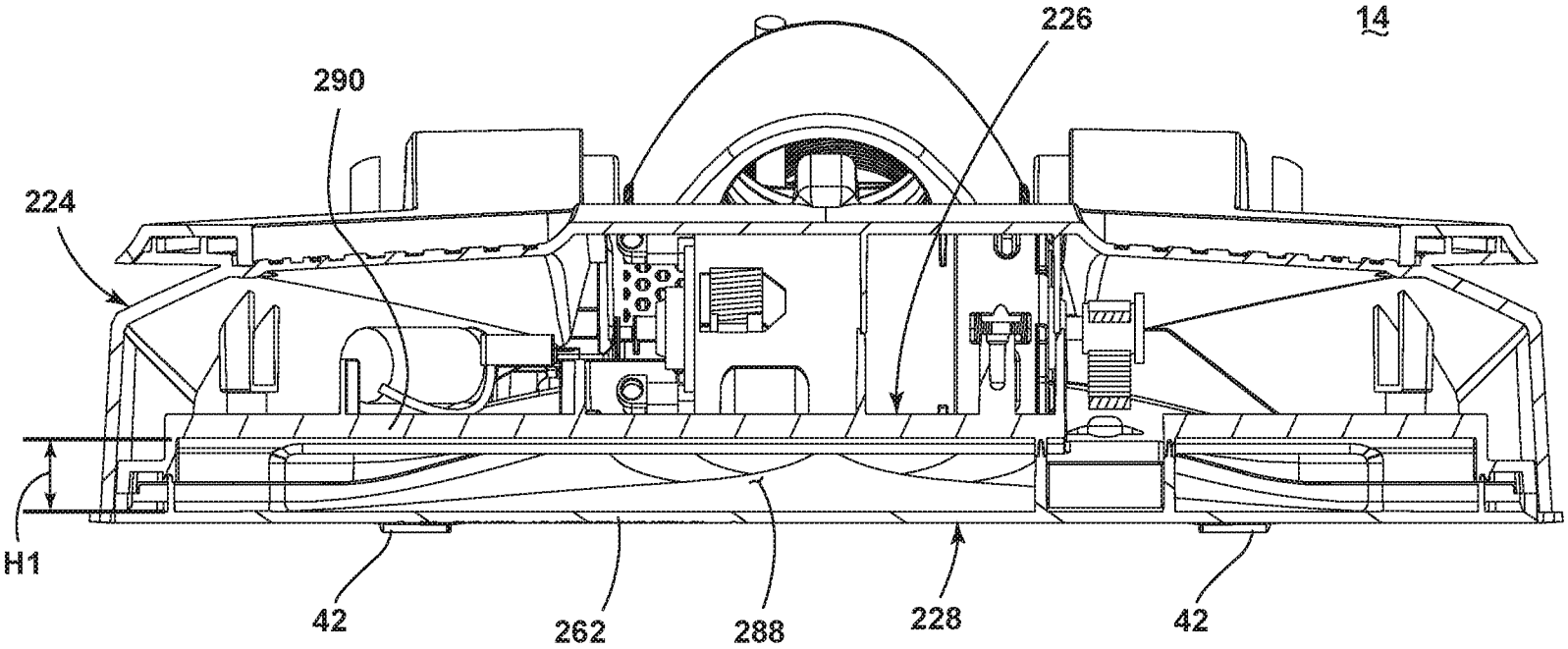
FIG. 12 is a partial cross-sectional view of the foot assembly of the vacuum cleaner taken along line XII-XII of FIG. 1.

FIGS. 11-12 show side and front cross-sectional views of the foot assembly 14 respectively, including the necked-down suction channel 230. A channel inlet 288 is defined between a lower edge 290 of the rear wall 242 of the agitator chamber 238 and the rear wall 262 of the sole plate/cover 228. The channel inlet 288 extends across the width of the agitator chamber 238, and the suction nozzle inlet 256. The height of the channel inlet 288, denoted as H1, is less than the height of the agitator chamber 238, which is denoted as H2, and the height of the channel outlet 252, which is denoted as H3. In one configuration, the height of the channel inlet 288, H1, is about 12 millimeters (mm), the height of the agitator chamber 238, H2, is about 55 mm, and the height of the channel outlet 252 is about 26.5 mm. The width of the channel inlet 288 and agitator chamber 238 is about 290 mm. The width of the channel outlet 252 is about 38.5. Thus, the cross-sectional area of the channel inlet 288 is about 35 square centimeters ($cm^2$), whereas the cross-sectional area of the agitator chamber is about 160 $cm^2$ and the cross-sectional area of the channel outlet 252, which is elliptical in the present embodiment, is about 8 $cm^2$. Thus, while the height H3 of the channel outlet 252 is greater than the height H1 of the channel inlet 288, due to its shape and width, the channel outlet 252 has a smaller cross-sectional area than the channel inlet 288. As illustrated, the minimum height of the necked-down suction channel 230 is located at the channel inlet 288, H1, which is less than ¼ the height of the agitator chamber, H2. As illustrated, the maximum height of the necked-down suction channel 230 is located at the channel outlet 252, H3, which is less than ½ the height of the agitator chamber 238. Thus, the height of the necked-down suction channel 230 ranges from at least 50% up to 75% less than the height of the agitator chamber 238, H2, along the entire length of the necked-down suction channel 230 from the channel inlet 288 having a height of H1, to the channel outlet 252 having a height of H3. And the cross-sectional area of necked-down suction channel 230 at H1 and H3 respectively is between about 5/23 and 1/29 the cross-sectional area of the agitator chamber, H2, or about 78% to 96% less than the cross-sectional area of the agitator chamber 238, H2. For the illustrated embodiment, the various heights and cross-sectional areas are generally determined along planes normal to a surface on which the foot assembly rests.

A volumetric flow rate of the working air stream flowing through the vacuum cleaner 10 is a measure of the volume of working air passing a point in the working air path per unit time and can be calculated as the product of the cross-sectional area of the air stream and the average velocity of the air stream through the system. The conservation of mass principle requires that the volumetric flow rate remain constant through the system. Thus, if the air stream encounters a restriction, such as a decrease in cross-sectional area of the working air path, for example, the velocity of the working air stream will increase to maintain a constant volumetric flow rate. Conversely, if the air stream encounters an expansion, such as an increase in the cross-sectional area of the working air path, the velocity of the working air stream will decrease to maintain a constant volumetric flow rate. In the illustrated embodiment, the working air stream velocity increases as it flows from the agitator chamber 238 through the channel inlet 288 and necked down suction channel 230, and the velocity increases again as the air stream passes through the channel outlet 252 due to the restrictions formed by decreased height and cross-sectional area of the channel inlet 288, H1 and channel outlet 252, H3 compared to the agitator chamber 238, H2. The restriction formed by channel inlet 288, H1, relative to the height and cross-sectional area of the agitator chamber 238, H2, increases the velocity of working air stream flowing through the channel inlet 288 along its entire length.

The increased velocity of the working air stream along the entire length of the channel inlet 288 enhances ingestion of debris into the necked-down suction channel 230 and can reduce deposits or collection of debris within the agitator chamber 238, thereby improving cleaning performance compared to a conventional suction nozzle without a necked-down suction channel. Conventional suction nozzles typically incorporate a suction channel or conduit comprising a tubular member that is roughly the same height as the agitator chamber. Additionally, the conduit is typically located at the center or near one end of the rear wall of the agitator chamber, and in use, the highest velocity air flow is focused at the conduit. Accordingly, the velocity of the air stream flowing through portions of a conventional suction nozzle farthest from the conduit is slower than the velocity of the air stream closer to the conduit. The non-uniform velocity of the air stream can diminish cleaning performance at the extremities of the suction nozzle compared to the suction nozzle 36 of the present invention, which is configured to effectively spread an air stream with a higher uniform velocity across the entire width of the channel inlet 288 resulting in improved cleaning performance across the entire width of the suction nozzle 36, including at the extremities on the ends of the suction nozzle 36, which can also improve cleaning performance. Additionally, the reduced height of the channel inlet 288 and forward portion of the necked-down suction channel 230 provides space for the motor mounting cavity 232 on the top side of the base housing 226, directly above a forward portion of the necked-down suction channel 230, which permits the foot assembly 14 to maintain a low profile appearance. The sole plate/cover 228 is a unitary component that can be removed from the base housing 226 to provide facile access the belt 244 and agitator 38 for cleaning or replacement, or to clear obstructions clogging the agitator chamber 238, necked-down suction channel 230 or channel outlet 252.

One advantage of the foot assembly 14 disclosed herein is that the sole plate/cover 228 forms a portion of a necked-down suction channel 230, which enhances ingestion of debris and reduces deposits or collection of debris within the agitator chamber 238 by increasing the velocity of the working air and evenly distributing the working air across the entire width of the suction nozzle 36. Previous vacuum cleaners 10 do not incorporate a necked-down suction channel fluidly connected downstream from the suction nozzle, which can result in slower airflow velocity, especially at the portions of the suction nozzle farthest from the nozzle outlet. Thus, the air flow across the suction nozzle is not uniform, which can reduce cleaning performance or require a more powerful suction source to compensate for the decreased cleaning performance. The vacuum cleaner disclosed herein has a necked-down suction channel 230 formed in part by a removable sole plate/cover 228 that increases the velocity of working air flowing through the suction nozzle and evenly distributes the airflow resulting in improved cleaning performance.

Another advantage that may be realized in the practice of some embodiments of the described vacuum cleaner 10 is that the sole plate/cover 228 is a unitary part with a forward portion that defines the suction nozzle inlet 256 and a rearward portion that defines a lower channel 254 of the necked-down suction channel 230. The sole plate/cover 228 can be removed from the base housing 226 as a single part to provide facile access to the belt 244 and agitator 38 for cleaning or replacement, or to clear obstructions clogging the agitator chamber 238, necked-down suction channel 230 or channel outlet 252. Some previous sole plates did not incorporate a forward portion forming a suction inlet and a rearward portion forming a necked-down suction channel 230 configured to be removed as a single piece to clear obstructions or to perform maintenance on the vacuum cleaner 10.

Another advantage that may be realized in the practice of some embodiments of the described vacuum cleaner 10 is that a multi-layer pre-motor filter assembly 98 and pre-motor filter housing 96 are configured to prevent misassembly and incorrect orientation of a bottom and top filter layer 126, 130 of the pre-motor filter assembly 98 within the pre-motor filter housing 96. Previous vacuum cleaners did not incorporate features to control the orientation of filter layers within a filter housing to ensure optimal filtration and cleaning performance. The bottom filter layer 126 disclosed herein is provided with a recess 142 and smaller diameter, d1, and the top filter layer 130 disclosed herein is provided with a larger diameter, d2, and does not have a recess. The pre-motor filter housing 96 disclosed herein is provided with an inward step 138 on the peripheral wall 136 and a boss 140, which both act to prevent misassembly and incorrect orientation of the bottom filter layer 126 and top filter layer 130.

Yet another advantage that may be realized in the practice of some embodiments of the described vacuum cleaner 10 is that an air bleed valve 178 is provided on the handle assembly 12 in fluid communication with the suction inlet and suction source for varying the level of suction and air flow through either of the suction nozzle inlet 256 when the vacuum cleaner is used in floor cleaning mode, or through the free hose end 160 or suction wand inlet 158 when the vacuum cleaner 10 is used in above-the-floor cleaning mode. With some previous air bleed valves, suction could be adjusted only through the suction wand or accessory tool because the air bleed valve was mounted directly to the suction wand or accessory tool. Because the air bleed valve 178 disclosed herein is mounted on the handle assembly 12, downstream from the vacuum hose 48, the air bleed valve 178 is configured to adjust suction through the vacuum hose 48, foot assembly 14 and suction wand 154 and thus increases versatility and functionality of the vacuum cleaner 10.

To the extent not already described, the different features and structures of the various embodiments of the foot assembly 14 with the necked-down suction channel 230, the multi-layer pre-motor filter assembly 98 and pre-motor filter housing 96, and the air bleed valve 178, may be used in combination with each other as desired, or may be used separately. That one vacuum cleaner is illustrated herein as having all of these features does not mean that all of these features must be used in combination, but rather done so here for brevity of description. Furthermore, while the vacuum cleaner 10 shown herein is an upright vacuum cleaner that includes a vacuum collection system for creating a partial vacuum to suck up debris (which may include dirt, dust, soil, hair, and other debris) from a surface to be cleaned and collecting the removed debris in a space provided on the vacuum cleaner 10 for later disposal, in some embodiments of the invention, not illustrated herein, the vacuum cleaner 10 can additionally have fluid delivery capability, including applying liquid or steam to the surface to be cleaned, and/or fluid extraction capability. Still further, while the vacuum cleaner 10 shown herein is an upright-type vacuum cleaner, the vacuum cleaner 10 can alternatively be configured as a canister-type vacuum cleaner, a stick vacuum cleaner, or a hand-held vacuum cleaner. Thus, the various features of the different embodiments may be mixed and matched in various vacuum cleaner configurations as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a housing adapted for movement over a surface to be cleaned;

an upright handle assembly pivotally mounted to the housing;

a separating and collection assembly;

a working air path having a working air inlet fluidly connected with the separating and collection assembly;

a suction source in fluid communication with the separating and collection assembly and configured to generate a working air stream through the working air path; and an air bleed valve configured to adjust a level of suction and air flow through the working air path, the air bleed valve comprising:

a valve conduit forming a portion of the working air path and comprising a conduit air vent therein; and a vent collar rotatably mounted on the valve conduit and comprising a sleeve defined by a collar wall encircling the valve conduit and having a plurality of collar air vents defined in the sleeve therein and generally located at opposed portions of the sleeve, wherein the vent collar is configured to selectively rotate at least one of the plurality of collar air vents into register with the conduit air vent to reduce the level of suction and air flow through the working air path and to selectively rotate the at least one of the plurality of collar air vents out of register with the conduit air vent to increase the level of suction and air flow through the working air path.

2. The vacuum cleaner of claim 1, wherein the plurality of collar air vents comprise a first group of multiple slots and a second group of multiple slots spaced via a solid portion of the collar wall, wherein the vent collar is configured to selectively rotate at least one of the first group of multiple slots or the second group of multiple slots into register with the conduit air vent to reduce the level of suction and air flow through the working air path and to selectively rotate the plurality of collar air vents out of register with the conduit air vent to increase the level of suction and air flow through the working air path.

3. The vacuum cleaner of claim 1, wherein the valve conduit comprises a plurality of conduit air vents therein.

4. The vacuum cleaner of claim 3, wherein the valve conduit comprises a solid wall portion separating the plurality of conduit air vents and the plurality of conduit air vents are spaced at opposite sides of the valve conduit.

5. The vacuum cleaner of claim 1, wherein the valve conduit comprises a conduit housing with annular mounting groove and the vent collar comprises a hook nested in the annular mounting groove for rotatably mounting the vent collar thereon.

6. The vacuum cleaner of claim 1, wherein the vent collar comprises grip ribs protruding from an outer surface of the sleeve.

7. The vacuum cleaner of claim 1, wherein the valve conduit comprises a suction control gage having multiple suction settings and the vent collar comprises an indicator arrow that can be aligned with one of the multiple suction settings on the suction control gage.

8. The vacuum cleaner of claim 1, wherein the air bleed valve is configured for adjustment between a minimum suction setting in which the air bleed valve is fully open and the level of suction and air flow through the working air path is minimized, and a maximum suction setting in which the air bleed valve is fully closed and the level of suction and air flow through the working air path is maximized.

9. The vacuum cleaner of claim 8, wherein the air bleed valve is configured for incremental adjustment between the minimum suction setting and the maximum suction setting.

10. The vacuum cleaner of claim 8, wherein the valve conduit comprises multiple detent recesses formed on an outer surface thereof, wherein one of the multiple detent recesses corresponds to the minimum suction setting and another one of the multiple detent recesses corresponds to the maximum suction setting, and the vent collar comprises a detent protrusion configured to snap into one of the multiple detent recess.

11. The vacuum cleaner of claim 8, wherein the air bleed valve comprises at least one intermediate suction setting between the minimum and maximum suction settings.

12. The vacuum cleaner of claim 1, wherein the separating and collection assembly comprises a filter assembly having a cavity for receiving multiple layers of filter media, wherein the filter assembly is configured for a predetermined arrangement of the multiple layers of filter media within the cavity.

13. The vacuum cleaner of claim 1, wherein the valve conduit further comprises a conduit housing with the conduit air vent therein and a conduit cover, the conduit housing including one of a tongue and a groove, the conduit cover including an other of the tongue and the groove and the conduit housing and the conduit cover mounted together via the tongue being received within the groove.

14. A vacuum cleaner, comprising:

a housing adapted for movement over a surface to be cleaned;

an upright handle assembly pivotally mounted to the housing;

a separating and collection assembly comprising an air inlet;

a working air path fluidly having a working air inlet fluidly connected with the air inlet to the separating and collection assembly;

a suction source in fluid communication with the separating and collection assembly and configured to generate a working air stream through the working air path;

a vacuum hose forming a portion of the working air path upstream of the air inlet to the separating and collection assembly; and an air bleed valve provided on the upright handle assembly and forming a portion of the working air path downstream from the vacuum hose and upstream of the air inlet to the separating and collection assembly, wherein the air bleed valve is configured to adjust a level of suction and air flow through the vacuum hose, the air bleed valve comprising a valve conduit defined by a conduit housing and a conduit cover, the conduit housing including one of a tongue and a groove, the conduit cover including an other of the tongue and the groove and the conduit housing and the conduit cover mounted together via the tongue being received within the groove.

15. The vacuum cleaner of claim 14, wherein the air bleed valve further comprises:

the conduit housing comprising a conduit air vent therein; and a vent collar rotatably mounted on the conduit housing and comprising a collar air vent therein, wherein the vent collar is configured to selectively rotate the collar air vent into register with the conduit air vent to reduce the level of suction and air flow through the working air path and to selectively rotate the collar air vent out of register with the conduit air vent to increase the level of suction and air flow through the working air path.

16. The vacuum cleaner of claim 14, wherein a first end of the vacuum hose is selectively removable from one of the housing or the upright handle assembly for above-the-floor cleaning.

17. The vacuum cleaner of claim 16, wherein a second end of the vacuum hose, opposite the first end, is fixedly mounted to the air bleed valve.

18. The vacuum cleaner of claim 16, wherein the upright handle assembly comprises a removable suction wand having a grip to facilitate movement of the upright handle assembly by a user, and wherein the suction wand is configured to be attached to the first end of the vacuum hose for above-the-floor cleaning.

19. The vacuum cleaner of claim 16, wherein the housing comprises a suction nozzle, and wherein a working suction inlet is defined by the suction nozzle when the first end of the vacuum hose is coupled with the upright handle assembly for floor cleaning, and wherein the working air inlet is defined by the first end of the vacuum hose when the first end of the vacuum hose is removed from one of the housing or the upright handle assembly for above-the-floor cleaning.

20. The vacuum cleaner of claim 14, wherein the separating and collection assembly comprises a filter assembly having a cavity for receiving multiple layers of filter media, wherein the filter assembly is configured for a predetermined arrangement of the multiple layers of filter media within the cavity.

* * * * *